United States Patent [19]

Zséger

[11] Patent Number: 4,775,153

[45] Date of Patent: Oct. 4, 1988

[54] TOY OF SKILL

[75] Inventor: László Zséger, Budapest, Hungary

[73] Assignee: Licencia Találmányokat Értékesitö és Innovácios Külkereskedelmi Vállalat, Budapest, Hungary

[21] Appl. No.: 12,664

[22] PCT Filed: May 15, 1986

[86] PCT No.: PCT/HU86/00030

§ 371 Date: Jan. 15, 1987

§ 102(e) Date: Jan. 15, 1987

[87] PCT Pub. No.: WO86/06976

PCT Pub. Date: Dec. 4, 1986

[30] Foreign Application Priority Data

May 22, 1985 [HU] Hungary ..... 1937/85

[51] Int. Cl.[4] ..... A63B 67/14; A63F 9/14

[52] U.S. Cl. ..... 273/109; 273/86 R; 446/446

[58] Field of Search ..... 273/108, 109, 112, 86 R, 273/110; 446/446, 450, 452, 453, 454

[56] References Cited

U.S. PATENT DOCUMENTS

| | | | |
|---|---|---|---|
| 3,206,890 | 9/1965 | Freyermuth | 273/110 |
| 3,209,491 | 10/1965 | Roeper | 273/86 R |
| 3,410,223 | 11/1968 | Miller | 273/86 R |

FOREIGN PATENT DOCUMENTS

| | | | |
|---|---|---|---|
| 1099684 | 3/1955 | France | 273/109 |
| 916513 | 8/1954 | Fed. Rep. of Germany | 446/446 |
| 1137663 | 10/1962 | Fed. Rep. of Germany | 446/446 |
| 2330784 | 1/1975 | Fed. Rep. of Germany | 273/109 |
| 598488 | 2/1948 | United Kingdom | 273/109 |

*Primary Examiner*—Richard C. Pinkham
*Assistant Examiner*—Gary Jackson
*Attorney, Agent, or Firm*—Schweitzer & Cornman

[57] ABSTRACT

The invention relates to a toy which has an annular frame with a curved, exposed interior surface. A small toy vehicle is movable by manually moving and orienting the frame, for rolling on wheels around the curved interior surface. A retaining tether attaches the toy vehicle to the frame to permit the wheels to leave the interior surface of the frame but not to separate it entirely from it. In the preferred embodiment a continuous channel is provided throughout the entire interior of the frame and a slit communicates between the interior channel and the exposed interior surface of the frame. One end of the tether is tied to the toy vehicle and the other end is tied to a bead retained within the channel and freely moving throughout the entire length.

6 Claims, 1 Drawing Sheet

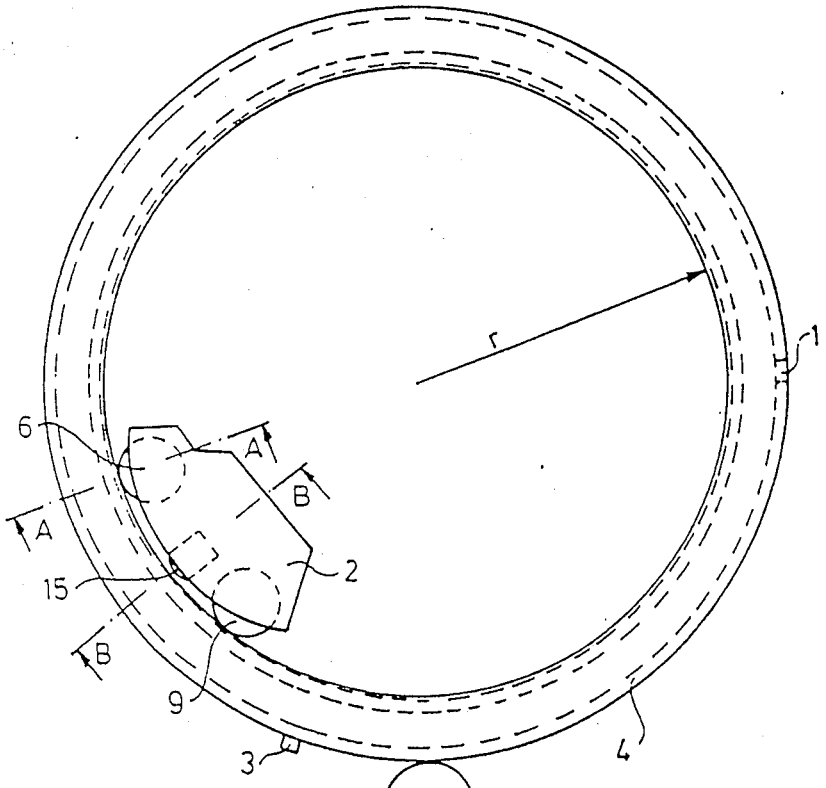
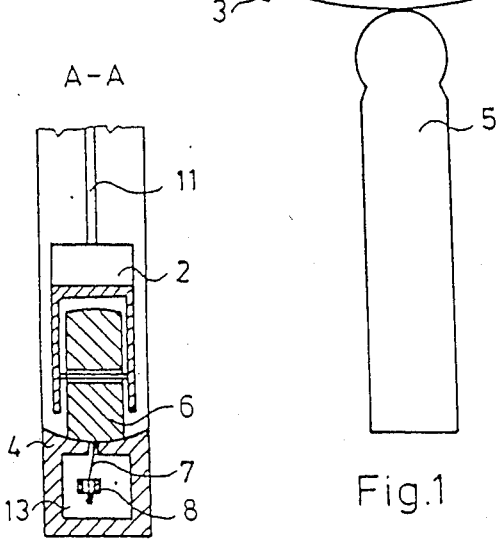
Fig.1
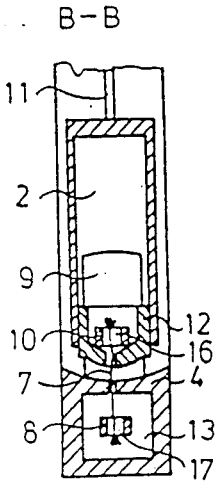
Fig.2
Fig. 3

TOY OF SKILL

FIELD OF THE INVENTION

The invention relates to a toy of skill.

BACKGROUND OF THE INVENTION

A variety of toys of skill are known. One variety is the class of gyroscopic toys. A toy of this type is described, for example, in U.S. Pat. No. 4,371,615, in which a hexagonally-shaped element is fixed to a vertical shaft having a pointed end at its bottom. The device comprises a game board divided into squares. The shaft is rotatable on the board. Names and numbers are entered into squares on the board, indicating the results attained by the players by the rotation.

A gyroscopic toy is described in Hungarian Pat. No. 171,914 in which the playing field is a movable board. A gyroscope is brought into rotation on the board, and is to be moved along a predetermined path. A rotating mechanism is built into the gyroscope to insure approximately equal periods of rotation.

Another group of toys of skill comprises the various hand-driven hoops that are trundled along on the ground and enabling the performance of various activities.

OBJECT OF THE INVENTION

The principal aim of the present invention is to develop a toy of skill that can be held in the hand and due to its small size can be taken out of the pocket at any time and anywhere, to improve the manual dexterity of the player. It should also be inexpensive and easy to manufacture.

SUMMARY OF THE INVENTION

According to the present invention, this aim is achieved by a toy of skill, having an annular frame that is provided at its outer surface with a handle and with a concave runway at its exposed inner surface the runway being arranged perpendicularly to the plane in which the radius of the frame rotates. A body rolling along said concave runway on at least tow wheels is fitted to said frame, the outer surface of said wheels being of convex shape fitting the concave surface of the runway, and a flexible attachment or tether is provided between the said body and said frame.

Suitably a slot is provided in the inner surface of the frame, preferably at its middle, and in the direction of the radius of the frame. The slot widens out within the frame to form a channel. The flexible attachment is suitably a filament led through the slot and fixed at one end to the body, preferably at its middle, and guided at its bottom, while the other end of the filament is fixed to a slide located in the channel.

The advantages of the toy of skill according to the invention are as follows:

- it improves the sense of rhythm and equilibrium,
- it improves attention and concentrating ability,
- it improves track-keeping capability, a useful property in car driving,
- it permits exercising with a cramp-free, slackened motion,
- it provides the possibility of exercising multi-directional movements,
- its further advantage is that it can be played in any posture, i.e. while standing, sitting or walking, and it is extremely entertaining and can be played in a competitive manner.

BRIEF DESCRIPTION OF DRAWING

The invention is further described by way of example only, with reference to the accompanying drawings, in which:

FIG. 1 is a front view of the toy,

FIG. 2 is a cross sectional view taken along the plane A—A of FIG. 1,

FIG. 3 is another cross sectional view taken along the plane B—B of FIG. 1.

DESCRIPTION OF PREFERRED EMBODIMENT

As it is apparent from FIG. 1, the toy has an annular frame 4 provided with a handle 5 fixed to the outer surface of frame 4. In its simplest form the frame 4 is made of two half rings produced e.g. by injection molding, and then glued together.

The inner surface of the annular frame 4 constitutes a runway 14. The runway 14 is concave in the direction perpendicular to the plane of rotation of the radius r of the frame 4 as it can clearly be seen in FIGS. 2 and 3. A slot 11 is provided in the exposed inner surface of the frame 4 forming the runway surface 14. The slot 11 is in the symmetry line of the runway 14 in the direction of the radius r. This slot 11 widens out to form channel 13 within the frame 4.

The slot 11 and the channel 13 that is connected to it run completely along the inner periphery of the annular frame 4 without interruption and continuously follow the runway 14. The width of the slot 11 is sufficient to permit a thin filament to be passed through it.

A body 2 running on two wheels 6 and 9 is placed onto the concave runway 14. The body 2 is a toy automobile illustrated the preferred embodiment, but it may have the shape of an airplane, a train or of any other body. The rolling surfaces of the wheels 6 and 9 are convex, fitting into the mating concave surface of the runway 14, as shown in FIG. 2.

The body 2 is flexibly attached to the frame 4 by the tether 15. One end of the flexible attachment or tether 15 is fixed to the body 2, advantageously in its middle part between the wheels 6 and 9. The tether passes through the bottom of the body 2. The tether 15 passes through the slot 11 in the runway 14, hanging into the channel 13 where it is fixed within the channel to permit its free movement along the slot 11, together with the movement of the body 2.

In the preferred embodiment the tether 15 is a filament 7 that is led through the slot 11. One end of the filament 7 is attached to a retaining element 10, which is a retaining bead located in a bush 12 attached to the body 2 between the wheels 6 and 9. The other end of the yarn 7 is tied to a retainer element 8 movable within the channel 13. In the preferred embodiment the filament 7 is threaded through a hole upwardly in the element 10 and is fixed to the element 10 at its top. The filament 7 is threaded through vertical bore 17 in the retainer element 8 and is fixed to the non-sliding bottom surface thereof. The filament 7 moving freely together with the element 8 follows the circular motion of the body 2 along the runway 14.

The upper end of the tether 15, can be arranged also is a manner that a through hole is provided in the body 2, suitably halfway between the wheels 6 and 9 and the filament 7 is fixed in the hole (not shown). In this case the bottom of the body 2 permits free motion of the filament 7 in all directions. The filament 7 is prevented from getting under the wheels 6 or 9 while the body 2 moves along the runway 14, to avoid impeding the free movement of the wheels 6 and 9.

In selecting the material of the filament 7, the requirement is to use filaments made of wear-resistant and very flexible material. This may be a plastic filament solid, braided or stranded, a natural fiber, metal filament or any other kind of filament or even a thin chain can satisfy the above requirements.

A hole 1 is provided in the outer surface of the frame 4. The filament 7 and the slide 8 in which it is fixed are introduced into that hole 1 during manufacture. If the filament 7 breaks, it can be replaced through the hole 1 or removed for repair.

When the body 2 stands still, it is fixed to the frame 4. A pin 3 is provided for this purpose on the outer surface of the frame 4. A resilient element, e.g. a rubber strip is attached to the pin 3 for fixing the body 2 to the frame 4.

The toy according to the invention is used as follows: The player holds the frame 4 by the handle 5 by the hand, and by moving the frame 4 back and forth, then up and down, sets the body 2 into motion to make it run around along the runway 14.

It is up to the skill of the player whether the body 2 remains on the runway 14 or is derailed from it. The flexible tether 15 prevents the body 2 from falling off the frame 4 when leaving the runway 14. The filament 7 becomes taut and the sliding element 8 is forced against the wall of the channel 13 provided with the slot 11 and prevents the body 2 from receding excessively from the frame 4 by keeping the body 2 hanging beside the frame 4. The game can be continued after placing the body 2 back onto the runway 14.

The concavity of the runway 14 and the radius of curvature of the convexity of the wheels 6 and 9 influence the difficulty of the game. The larger the radius of curvature, the easier will the body 2 be derailed from the runway 14, i.e. the more difficult to keep the body 2 on the runway 14, and the more difficult will be the game.

I claim:

1. A toy comprising an annular frame, said annular frame having a transversely curved, exposed interior runway surface, means movable by manual transmission of force by the player for rolling about on said curved interior surface, said movable means having rolling means for said rolling, and retaining means disposed between said movable means and said annular frame to permit the rolling means of said movable means to leave said interior surface but to prevent said movable means from receding excessively from the frame.

2. The toy of claim 1, wherein said rolling means is curved in the opposite sense than the curvature of said exposed interior surface.

3. The toy of claim 1, wherein said frame contains a continuous cavity therein, said cavity communicating with said interior surface via a continuous slot in said surface, and wherein said retaining means comprises a filament attached at one end thereof to said movable means and retained at its other end within said cavity for free movement therein.

4. A toy comprising an annular frame having in its inner surface a concave runway for a wheeled body, a slot being provided in said runway along the longitudinal axis thereof and communicating with a channel within said frame, wherein said channel is formed to receive a freely movable slide and a tether passing through said slot, a tether connected at its one end to said wheeled body and at its other end to said slide, said tether being of a length to permit said wheeled body to leave the runway but not to recede excessively from the frame.

5. The toy of claim 4 wherein said wheeled body is provided with at least two wheels, and the tether is connected to said body between said two wheels.

6. The toy of claim 4 wherein said frame is provided with a handle attached to its outer surface.

* * * * *